United States Patent [19]

Wilson

[11] Patent Number: 4,924,689

[45] Date of Patent: May 15, 1990

[54] ROLLING MILL

[75] Inventor: Alexander I. Wilson, Sheffield, England

[73] Assignee: Morgan Construction Company, Worcester, Mass.

[21] Appl. No.: 163,088

[22] Filed: Mar. 2, 1988

[30] Foreign Application Priority Data

Mar. 4, 1987 [GB] United Kingdom ..... 8705042
Mar. 4, 1987 [GB] United Kingdom ..... 8705043

[51] Int. Cl.[5] ..... B21B 35/00

[52] U.S. Cl. ..... 72/249; 72/238; 72/235; 74/606 R

[58] Field of Search ..... 72/249, 238, 239, 235, 72/248; 74/325, 606 R

[56] References Cited

U.S. PATENT DOCUMENTS

| | | | |
|---|---|---|---|
| 3,001,409 | 9/1961 | Fumetti | 74/606 R |
| 3,143,004 | 8/1964 | Haskin, Jr. | 74/606 R |
| 3,646,795 | 3/1972 | Hinterholzl | 72/238 |
| 3,686,919 | 8/1972 | Brusa | 72/249 |
| 4,182,149 | 1/1980 | Wilson | 72/249 X |
| 4,325,245 | 4/1982 | Sherwood | 72/248 |
| 4,669,294 | 6/1987 | Wilson | 72/249 |
| 4,807,458 | 2/1989 | Buch et al. | 72/249 |

FOREIGN PATENT DOCUMENTS

| | | | |
|---|---|---|---|
| 0126059 | 11/1984 | European Pat. Off. | 72/235 |

*Primary Examiner*—W. Donald Bray
*Attorney, Agent, or Firm*—Samuels, Gauthier & Stevens

[57] ABSTRACT

A rolling mill provided with a pair of rolls rotatable in a roll housing and in a first mode of operation drivably connected to respective drive gears of a main frame and gear housing, the drive gears meshing with respective pinions which mesh together, the main frame and gear housing being capable of being located in either one of two positions angularly spaced at 180 degrees, and the drive gears and pinions are capable of being re-adjusted in position whereby in a second mode of operation the drive gears can be brought into mutually meshing positions and the pinions can be moved apart to become the gears with which the rolls are drivably connected.

12 Claims, 7 Drawing Sheets

ROLLING MILL

BACKGROUND OF THE INVENTION

FIELD OF THE INVENTION

The invention relates to the rolling of metal, and is concerned in particular with improvements in rolling mills for rolling various metal sections.

It is a particular problem to design a rolling mill which can be fitted with either relatively small rolls or relatively large rolls to suit the particular metal sections being worked and to drive the selected rolls at appropriate speeds and/or with sufficient torque.

It is also a problem in the design of rolling mills that, because of the need to roll at the highest possible rates of production, coupled with the fact that rolling loads within the roll stands are increasing, the driving of the rolls by means of universally jointed shafts is very often a limiting factor. This is because, although such shafts are capable of transmitting high torque when the driving shafts and rolls which they connect are in line, their torque transmitting capacity rapidly falls off when the rolls are moved out of alignment with the gearbox driving shafts, as of course they must often be when the roll gap is varied and even more so if the rolls are to be changed for different diameter rolls. Consequently, to reduce angularity, the universally jointed shafts in some cases need to be unduly long which results in a cumbersome (i.e. space consuming) arrangement and one which is not torsionally stiff.

The object of the invention is to provide a rolling mill which can be fitted with either relatively small rolls or relatively large rolls to suit the particular metal sections to be worked but which does not employ universally jointed shafts.

Another object of the invention is to solve the problem of how rolls of such widely varying diameters can be driven at appropriate speeds and/or with sufficient torque.

These and other objects and advantages of the invention are achieved by providing a rolling mill comprising a roll housing; a pair of cylindrical work rolls rotatable in said roll housing; a main frame and gear housing; respective drive gears located within said main frame and gear housing and in a first mode of operation of the mill drivably connected to said work rolls; respective pinions located within said main frame and gear housing and in constant mesh with the respective drive gears, said pinions in said first mode of operation of the mill meshing together and the respective drive gears being adjustable towards or away from each other, to suit the spacing of the rolls in the roll housing, by orbital adjustments of said drive gears around the respective pinions, mechanism whereby the main frame and gear housing can be located in either one of two positions angularly spaced at 180 degrees, and mechanism whereby the drive gears and pinions are capable of being re-adjusted in position within the main frame and gear housing so that for a second mode of operation of the mill the drive gears can be brought into mutually meshing positions and the pinions can be moved apart from their mutually meshing positions to become the gears with which the rolls are drivably connected, the pinions then being adjustable towards or away from each other, to suit the spacing of the rolls in the roll housing, by orbital adjustments of said pinions around the respective drive gears so that, depending upon the orientation of the main frame and gear housing and the adjustment of the gearing, there is obtained either a speed increase or a gearing down through the main gearbox, this providing a speed differential between the different roll drives obtained so that rolls of widely varying diameters can be driven at appropriate speeds.

Preferably, the drive gears and respective pinions with which they are in constant mesh will be located in respective cage members and so that for the first mode of operation of the mill the drive gears can be brought into mesh with each other and the pinions moved apart for orbital adjustment around their respective drive gears to suit the spacing of the rolls, and, when required, for the second mode of operation of the mill said pinions can be brought into mesh with each other and the drive gears moved apart for orbital adjustment around their respective pinions, again to suit the spacing of the rolls, said cage members preferably being secured for pivotal adjustment about the axes of the respective drive gears or of the respective pinions, selectively.

Preferably, also, means whereby either the pair of drive gears or the pair of pinions can be maintained in mesh, and the respective cage members secured for pivotal adjustment about the axes of the respective drive gears or of the respective pinions, selectively, include pairs of clamping plates pivotally movable about respective pivots and capable of being secured in alternative positions in which respective pairs of part-circular apertures selectively locate sleeve portions, concentric with the drive gears and pinions respectively, in respective part-circular seatings formed within the main frame and gear housing. The pairs of clamping plates may be movable about the respective pivots and secured in their alternative positions by means of a rotatable screw mechanism including a rotatable shaft with oppositely handed screwthreaded portions engaging respective nuts trunnion mounted between lever portions of the respective pairs of clamping plates, the shaft being adapted for rotation by an extraneous tommy-bar.

Means for effecting adjustments of the roll centres towards or away from each other preferably include pairs of eccentric sleeves located in bores in the roll housing, and compensating adjustment of the rolls to retain their axial alignment with the drive gears or with the pinions as the case may be will preferably be effected by re-adjustment of the roll housing in guides extending perpendicular to a plane containing the axes of the rolls. The main frame and gear housing will preferably have on its opposite end faces mounting means either one of which can receive the roll housing.

The main frame and gear housing will preferably be rotatably mounted for convenient positional adjustment into the selected one of its two angularly spaced positions. A hydraulically operated rotary actuator will preferably be provided to rotate the main frame and gear housing into the selected one of its two angularly spaced positions. The main frame and gear housing may be rotatable about a vertical axis for positional adjustment into the selected one of its two angularly spaced positions, the rolls of the roll housing being mounted for rotation about horizontal axes and being located at one end of the main frame and gear housing. Alternatively, the main frame and gear housing may be rotatable about a horizontal axis for positional adjustment into the selected one of its two angularly spaced positions, the rolls of the roll housing being mounted for rotation about vertical axes and being located above the main frame and gear housing.

DETAILED DESCRIPTION OF PREFERRED EMBODIMENTS.

Figure 1:
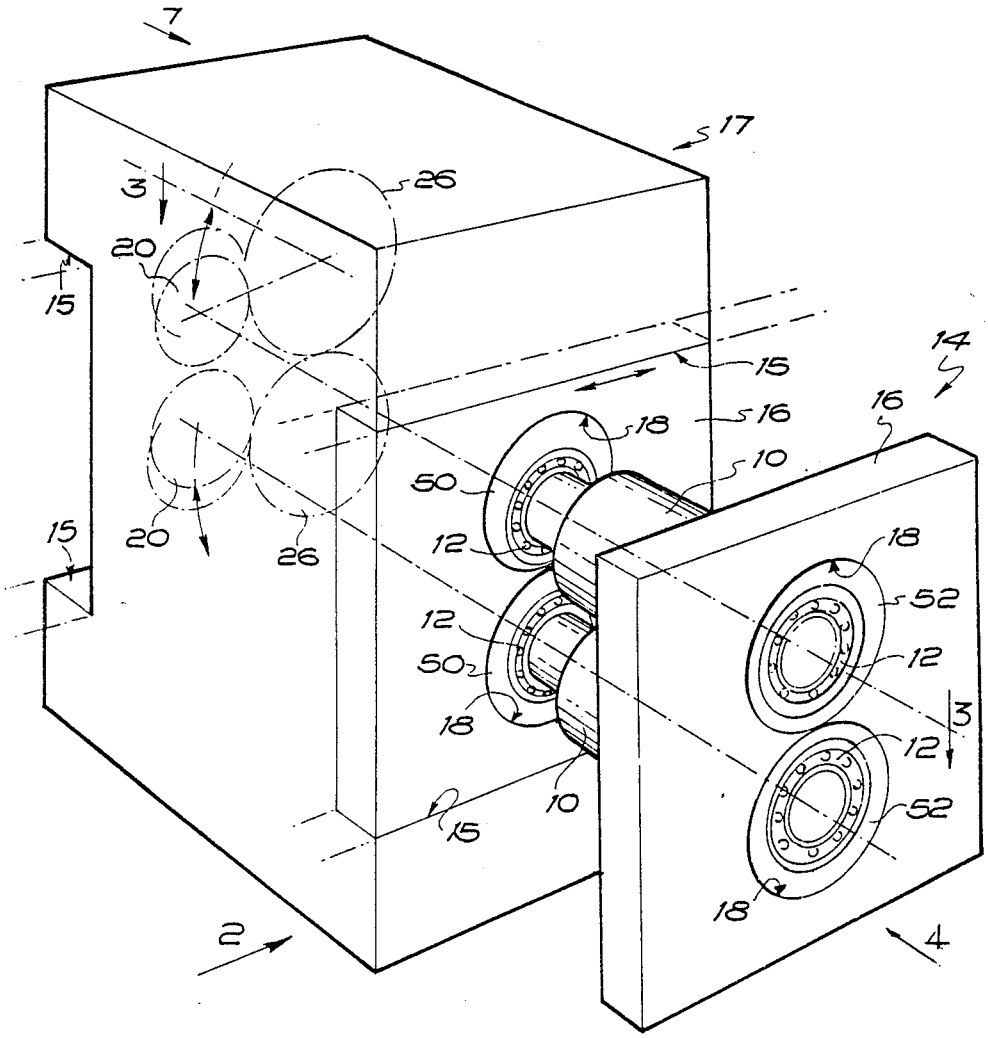
FIG. 1 is a perspective and purely diagrammatic view of a rolling mill embodying the invention.

Referring now to FIG. 1 of the drawings, a first embodiment of a rolling mill in accordance with the invention includes a pair of rolls 10,10 located in respective pairs of bearings 12,12 carried in a roll housing generally indicated 14, the latter being represented in FIG. 1 as two substantial rectangular plates 16,16 with pairs of bores 18,18 for the reception of roll mounting and adjustment means. The roll housing is capable of compensating adjustment, for a purpose and in a manner which will presently be described, along guides indicated 15, on an end face of a main frame and gear housing generally indicated 17. It will be observed that both end faces of the main frame and gear housing are provided with guides 15 for a reason which will also be described presently.

Figure 2:
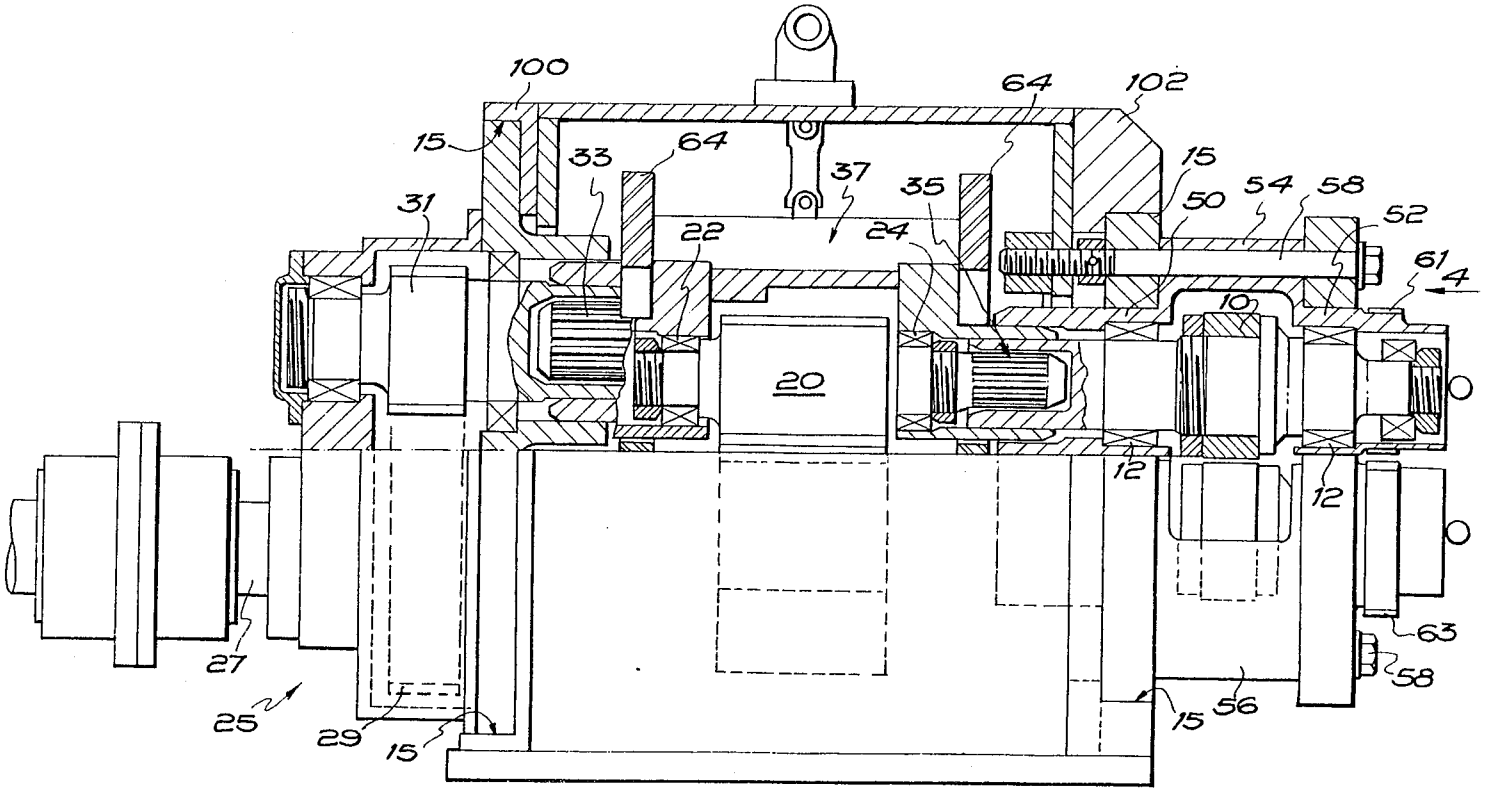
FIG. 2 is a part sectional view of an actual installation, looking in the direction of arrow 2 in FIG. 1.
Figure 4:
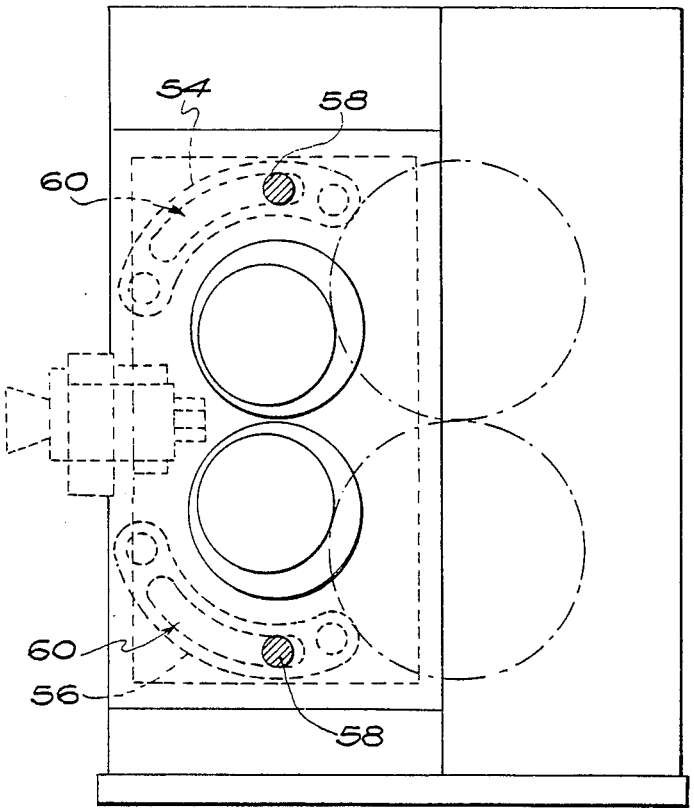
FIG. 4 is a view of the actual installation looking in the direction of arrow 4 in FIG. 1.

The roll mounting and adjustment means referred to are constituted by pairs of eccentric sleeves 50,52 which extend through the pairs of bores 18,18 in the plates 16,16. The pairs of sleeves are formed integrally with kidney shaped elements 54,56 (not shown in FIG. 1) which, in addition to connecting the pairs of sleeves together for simultaneous rotation when roll centre adjustments are being made, act as spacers between the plates 16,16 of the roll housing as best seen in FIG. 2. The plates 16,16 are bolted together, with the kidney shaped elements 54,56 between them, by a pair of bolts 58,58. Said bolts extend through respective arcuate slots 60 in the kidney shaped elements (see FIG. 4) so that rotational adjustments of the pairs of eccentric sleeves can be effected to vary the roll gap when the bolts have been slackened.

Figure 5:
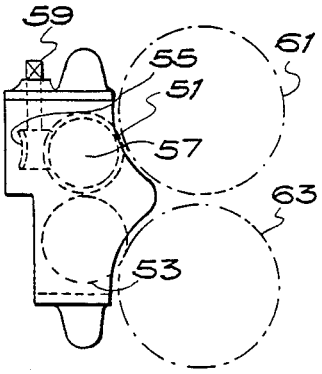
FIG. 5 is a view of screwdown mechanism for effecting adjustments of the roll gap.

Screwdown mechanism which is provided for effecting adjustments of the roll gap is illustrated in FIG. 5. This includes a pair of gears 51,53 which mesh together and with respective gears 61 and 63 to enable the pair of eccentric sleeves to be rotated with equal and opposite movement. As shown in FIG. 2, the gears 61 and 63 are formed on extensions of the respective eccentric sleeves 52,52. The gear 51 is drivably connected to worm and wormwheel mechanism 55,57 the worm of which can be rotated manually by means of an extraneous handle (not shown) which can be connected to a spindle with a square end 59.

In a first mode of operation of the rolling mill, as set up in FIGS. 1 to 4 and FIG. 7, the rolls 10,10 are driven by respective drive gears 20,20 housed within the main frame, said drive gears being mounted in respective pairs of bearings 22,24 and located in constant alignment with said rolls as will presently be described. They are therefore able to be connected to the respective rolls by splined connections 35 (see FIGS. 2 and 3) with a very high torque transmitting capacity. The drive gears 20,20 are in constant mesh with respective pinions 26,26, the latter being mounted in bearings 28,30 (see FIG. 3) and being in constant mesh with each other as shown diagrammatically in FIG. 1. The manner in which the drive gears 20,20 are adjustable, which will be described in detail presently, allows said gears to move orbitally around their respective pinions as roll gap adjustments are made, this being shown diagrammatically in chain-dotted lines in FIG. 1. The drive gears thus remain in constant and complete mesh with their respective pinions at all times.

Figure 3:
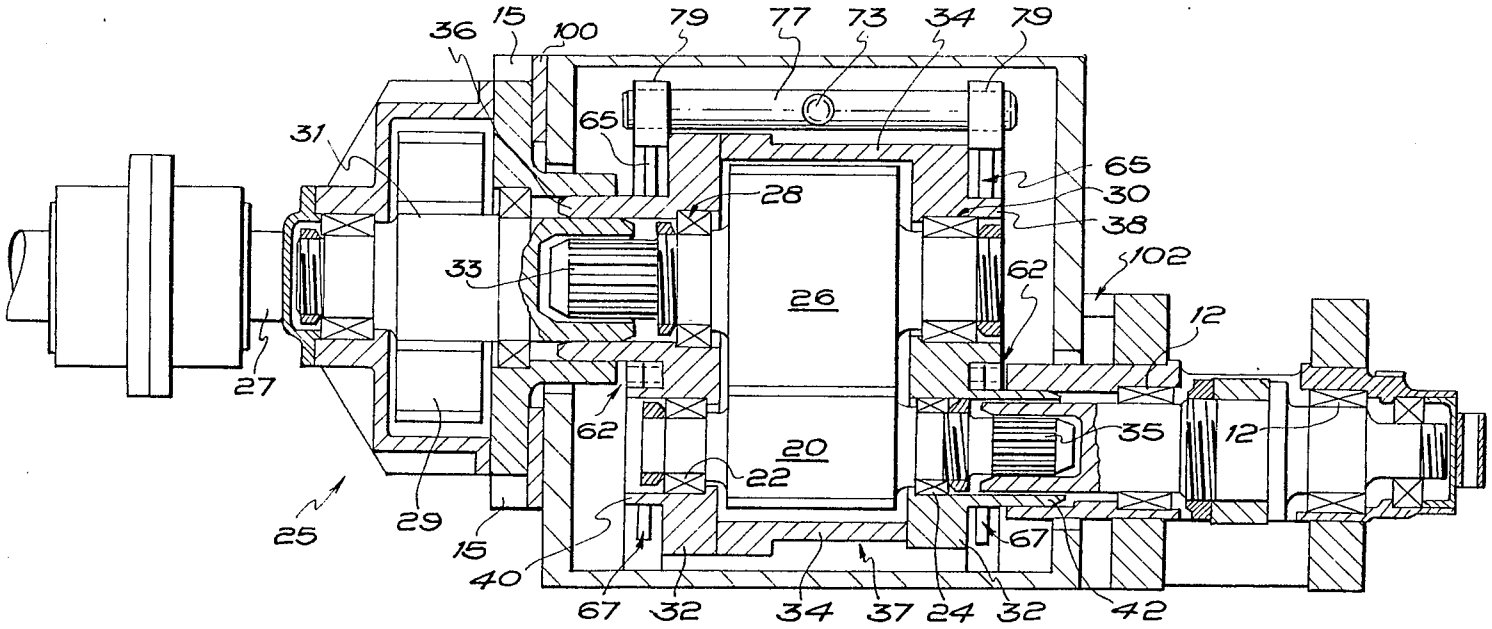
FIG. 3 is a sectional view on the line 3—3 in FIG. 1.

Referring now in particular to FIGS. 2 and 3, it will be seen that at the end of the main frame and gear housing remote from the roll housing, there is bolted an input drive gearbox generally indicated 25. This includes an input drive shaft 27, a main drive gear 29 and a main drive pinion 31 drivably connected to one of the pinions 26 by means of a splined connection 33.

As previously explained, roll gap adjustments are effected by rotational adjustments of the pairs of eccentric sleeves 50,52 with equal and opposite movement. It will be apparent that since the drive gears 20,20 are maintained in axial alignment with the respective rolls at all times, and that each drive gear moves along a much larger radius as it makes a simultaneous positional adjustment about its respective pinion 26 with which it is in constant mesh, this can only take place if roll gap adjustment is accompanied by a compensating adjustment of the roll housing 14 along the guides 15 on the end face of the main frame. Thus it will be understood that before roll gap adjustments are made, the bolts 58,58 which clamp the roll housing in position on the main frame will be slackened and rotational adjustments of the pairs of eccentric sleeves will then effect the required roll gap adjustment and simultaneously bring about the required compensating adjustment of the roll housing along the guides 15. In other words, by virtue of the fact that the drive gears are located in axial alignment with the rolls by the splined connections 35, the drive gears 20,20 take up their required positions about the respective gears 26,26 according to the spacing of the rolls, and the roll housing takes up a resultant position along the guides 15 according to the positioning of the drive gears and according to the particular orientation of the eccentric sleeves. (This is true irrespective of the "throw" of the eccentric sleeves. Thus it is a simple matter to mount a different roll housing in position if required, the replacement housing having different diameter rolls and/or different roll spacing outside the range of roll spacing available with the original roll housing).

Figure 6:
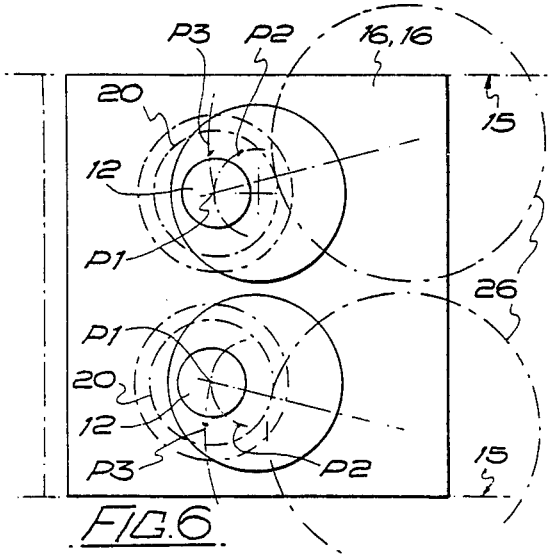
FIG. 6 is a diagrammatic illustration of how roll gap adjustments are effected.

This is illustrated diagrammatically in FIG. 6 the dimensions of which have been modified somewhat for the sake of clarity but which it is thought illustrate the movements of the various elements of the apparatus more clearly. It will be seen that as the eccentric sleeves are rotated with equal and opposite movement, as indicated by the arrows, to bring the centres of rotation of the bearings 12,12 from the positions P1,P1 to the positions P2,P2, the drive gears 20,20 can only move about the axes of the respective pinions 26,26 from the positions P1,P1 to the positions P3,P3. Consequently, to ensure that the positions P2 and P3 always coincide it is necessary for the roll housing, represented by the two substantial metal plates 16,16, to make the compensating movement indicated by the chaindotted line, this being equal to the misalignment between the points P2 and P3 which would otherwise take place. (It will be understood that this is a notional misalignment only, for purposes of illustration. In other words it is a misalignment which never in fact occurs because the rolls and their associated drive gears are maintained in constant alignment at all times by the splined connections 35).

Referring now in particular to FIG. 3, it will be seen that the bearings 22,24 in which the drive gears 20,20 are mounted, and the bearings 28,30 in which the respective pinions 26,26 are mounted, are located in pairs of carrier plates 32,32. Said carrier plates together with respective connecting casing members 34 form extremely robust cage members 37 (which in the first mode of operation of the mill, as the mechanism is set up as shown in FIGS. 1 to 4 and FIG. 7, locate the drive gears for constant mesh orbital adjustment about their respective pinions 26,26 as adjustments of the roll centres takes place). As shown, the pairs of carrier plates are provided with sleeve portions 36,38 which, in said first mode of operation, as the mechanism is set up in FIGS. 1 to 4 and FIG. 7 locate the cage members in the main frame and gear housing, said sleeve portions being concentric with the respective pinions 26. In addition, the sleeve portion 36 shown in FIG. 3, being relatively long, serves to guide the shaft of the input pinion as the input drive gearbox 25 is being fitted in position, the respective casing sleeve of said input drive gearbox locating on the outer periphery of said sleeve portion 36 as shown in FIG. 3.

Further sleeve portions 40 and 42 are provided on the pairs of carrier plates. The sleeve portions 42 are relatively long and facilitate the drive gears 20,20 being brought into line with spline connections 35 of the rolls as a roll housing 14 is being mounted in position on the end face of the main frame and gear housing 17. The further sleeve portions 40 and 42 are concentric with the respective drive gears 20 but, in this first mode of operation, as the mechanism is set up in FIGS. 1 to 4 and FIG. 7, these sleeve portions at this time play no part in locating the cage members in the main frame and gear housing.

Figure 7:
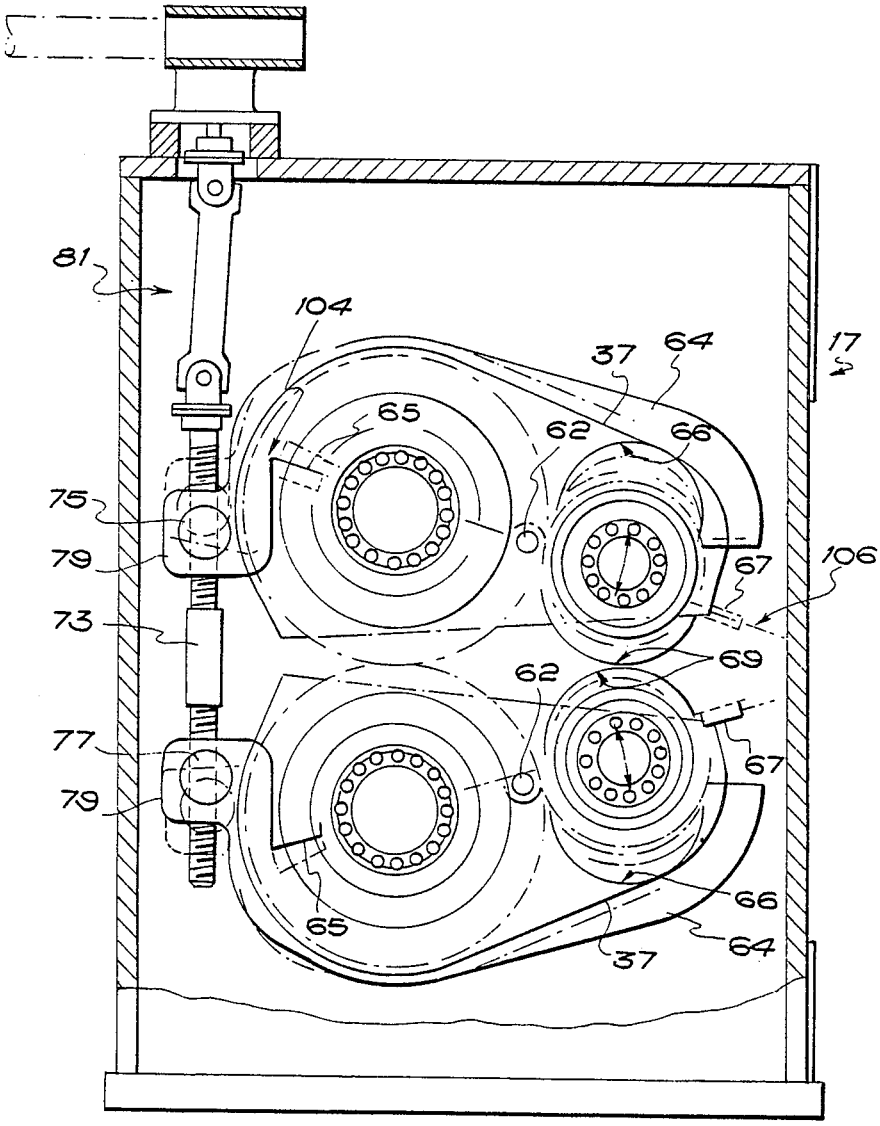
FIG. 7 is a diagrammatic view looking in the direction of arrow 7 in FIG. 1.
Figure 8:
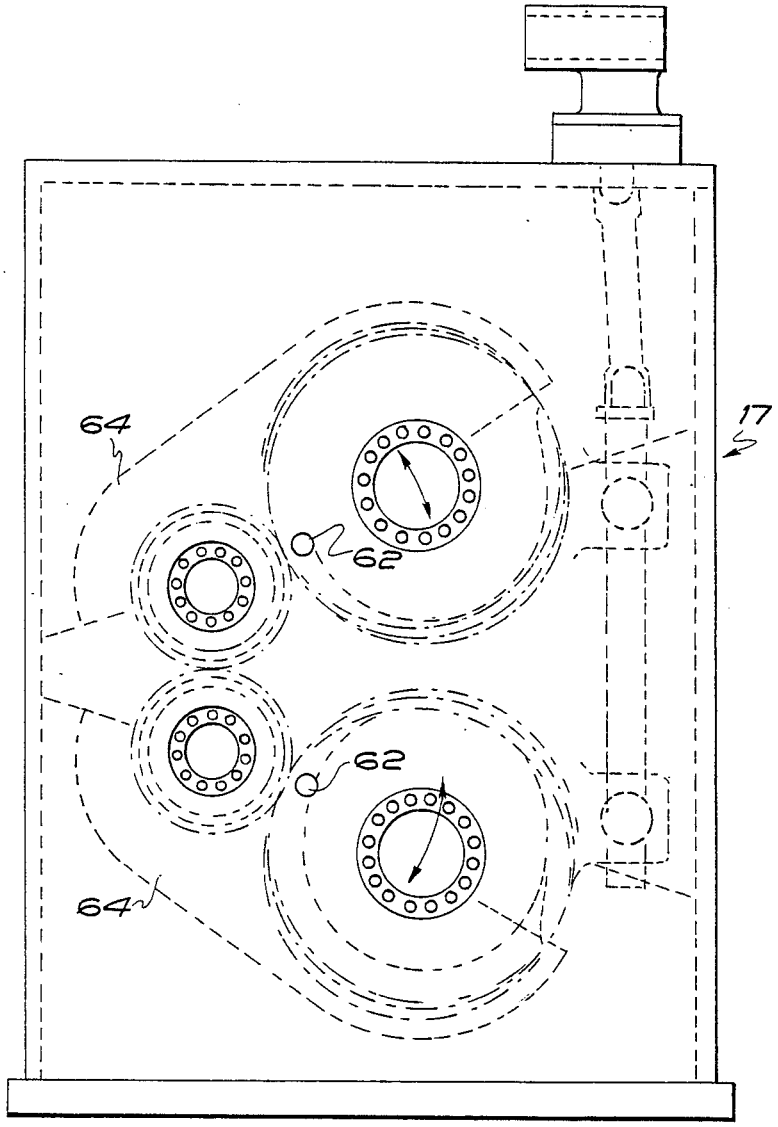
FIG. 8 is a similar view to FIG. 7 when a roll change has been effected.

Referring now to FIGS. 7 and 8, these illustrate the fact that the extremely robust cage members generally indicated 37,37 formed by the pairs of carrier plates 32,32 and casing members 34 are pivotally mounted within the main frame and gearbox 17 for movement about alternative pairs of pivots. In other words they can move about the axes of the respective drive gears or of the respective pinions. The arrangement is such that, instead of the pinions 26,26 being in constant mesh with each other as previously described, and providing a speed increase to the rolls as shown in FIG. 7, the drive gears 20,20, in a second mode of operation of the mill, can be brought into mesh with each other as the pinions 26,26 are moved apart as shown in FIG. 8. Moreover, since the main frame and gear housing is capable of being turned around end to end as will presently be described, and FIG. 8 is a view of the apparatus when this has been effected, the pinions 26,26 in said second mode of operation can then become the gears connected by splined connections to the respective rolls and one of the drive gears will be the gear receiving drive from the main drive pinion 31. There is therefore obtained a substantial gearing down in the drive to said rolls in said second mode of operation. (It will of course be understood that there will at this same time be fitted a replacement set of rolls of larger diameter than before, for which the gearing down and consequent greater torque is appropriate, conveniently by the replacement of the entire roll housing as a unit by a roll housing of the same basic design as that described and illustrated, and this is why the main frame and gear housing in FIG. 1 is shown to have guides 15 at its opposite ends. The guides 15 in FIGS. 2 and 3 are shown to be provided in respective adaptor plates 100 and 102 at the opposite ends of the main frame and gear housing 17. The splined connections of the new roll shafts will match the splined shafts of the pinions 26. The splined connection of one of the drive gears 20,20 will be suitably adapted for connection to the main drive pinion 31 of the replacement input gearbox 25 which will also be fitted at this time, the replacement gearbox 25 being designed both to cater for the variation which will be apparent between the centre heights of the gear 20 and pinion 26 receiving drive from the input gearbox and to make any appropriate variation in the input drive speed). During the geared down second mode of operation, adjustments of the roll centres towards or away from each other results in the pinions 26,26 performing orbital adjustments around the respective drive gears 20 as indicated in chain-dotted lines in FIG. 8, the roll housing being able to make compensating adjustments along the guides 15 as previously explained.

As shown in FIGS. 7 and 8, the means whereby either the pinions 26,26 or the drive gears 20,20 can be maintained in mesh according to the mode of operation required include respective pairs of clamping plates 64,64 (see also FIG. 2) pivotally movable about respective pivots 62,62. The clamping plates are provided with part circular apertures 66 and 68 which can clamp the sleeve portions 36,38 or 40,42, selectively, in respective part circular seatings 69 and 71 formed within the main frame and gear housing. The part circular seatings are formed, as shown, in inclined surfaces of internal frame parts, these surfaces each having abutment areas 104 and 106 against the one or the other of which the respective clamping plate is tightly clamped to locate the selected sleeve portions firmly but rotationally adjustable in their respective seatings. The abutment areas 104 and 106 of each of the inclined surfaces are provided with upstanding key pieces 65 and 67 (see FIGS. 3 and 7) engageable with slots in the areas of the clamping plates which are brought alternately into clamping engagement with said abutment areas. The clamping plates are movable between their alternate positions by mechanism including a rotatable shaft 73 with oppositely handed screwthreaded portions engaging respective nuts 75,77 trunnion mounted between lever portions 79 of the respective pairs of clamping plates. The shaft 73 is capable of being rotated by an extraneous tommy bar (shown in chain-dotted lines in FIG. 7) by way of a universally jointed connecting shaft 81.

It will be understood that the clamping plates are not clearly visible in FIG. 3 because of the section taken, but the key pieces 65 and 67 and the respective pivots 62,62 can be seen in that view.

Figure 9:
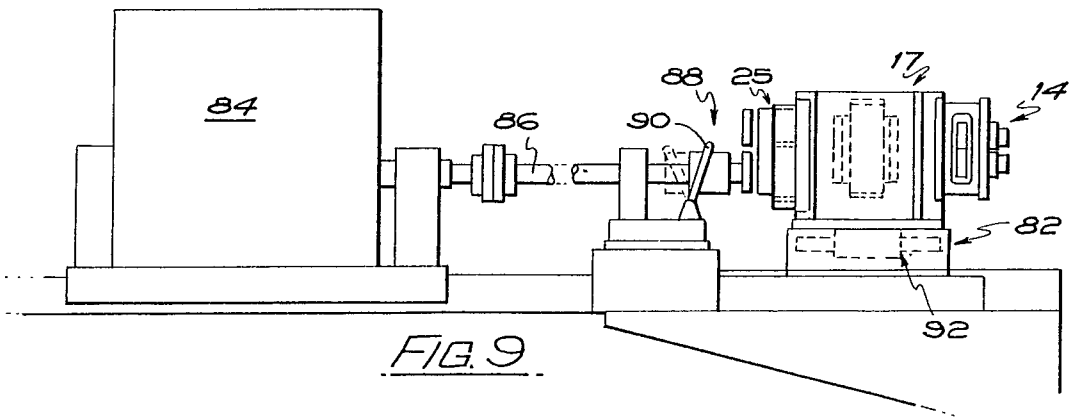

Referring now to FIG. 9, this illustrates the manner in which the arrangement just described can be arranged in a rolling mill. The main frame and gear housing 17 is shown to be mounted on a base 82 with the input drive gearbox 25 and roll housing 14 mounted on opposite faces as described above. The input drive gearbox is shown to be connected to a motor 84 by means of an in-line drive shaft 86, the latter incorporating a quick release coupling 88 which is manually operable by means of a lever 90.

The base 82 contains a hydraulically operated rotary actuator generally indicated 92 and the arrangement is such that when the quick release coupling has been disconnected by moving the lever 90 to the position shown in chain-dotted lines, the main frame and gear housing can be rotated through 180 degrees about a vertical axis. The input drive gearbox and roll housing can thus be transposed (but it will of course be understood that the roll housing, or more conveniently a replacement roll housing, will then have different diameter rolls to suit the speed increase or gear down obtained by the reversal of drive through the main gearbox).

Figure 10:
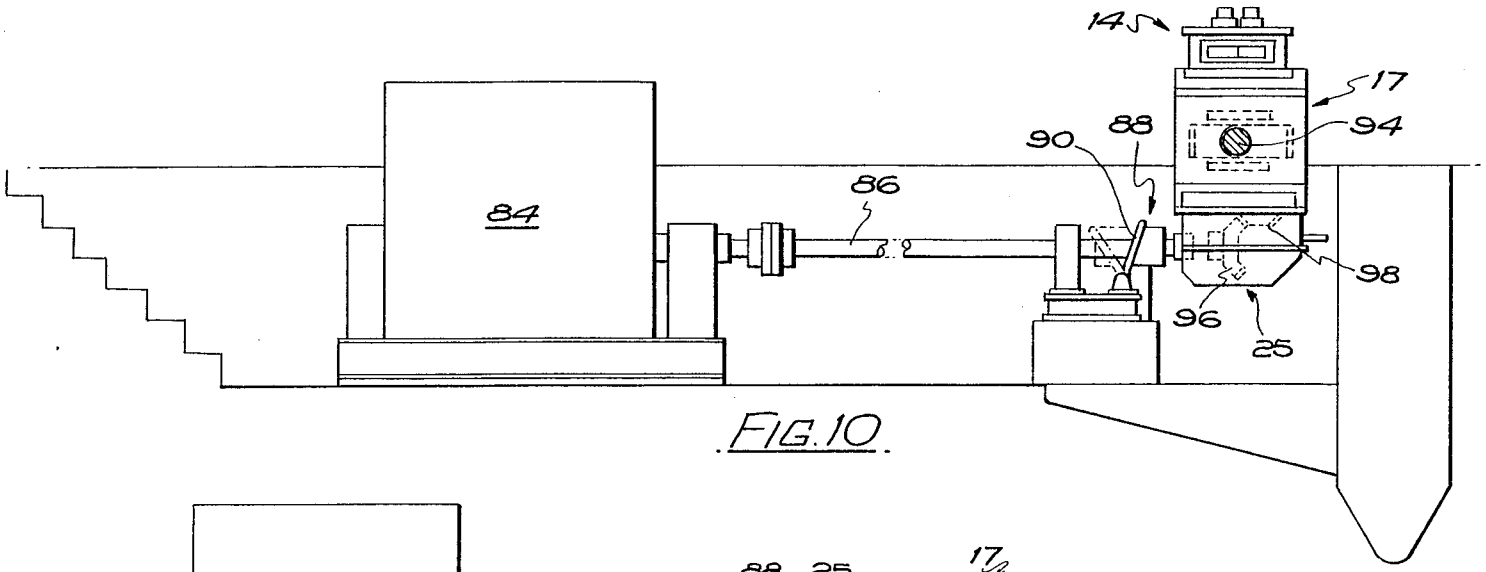
FIGS. 9 and 10 are views showing apparatus embodying the invention installed in a rolling mill.

In FIG. 10 there is illustrated a very similar arrangement to that just described except that the roll housing is located on an upper face of the main frame and gear housing 17 and with its rolls vertically arranged. Consequently, the main frame and gear housing 17 is trunnion mounted for rotation about a horizontal axis 94 (again by means of a rotary actuator not shown in this view). In this arrangement, the input drive gearbox 25 incorporates bevel gears 96 and 98. However, the installation can be operated in almost exactly the same way as that described with reference to FIG. 9. When the lever 90 of the quick release coupling 88 has been moved to the position shown in chain-dotted lines, the main frame and gear housing can be inverted. The input drive gearbox and roll housing can thus be transposed relative to the main frame and gear housing so that there can be obtained either a speed increase of a gearing down in the drive to the rolls as previously described.

In all these arrangements described, the roll housings and input drive gearboxes will not pose any problem of handling to enable them to be transposed as required. However, special handling apparatus could quite well be provided for effecting this in the most convenient manner.

Thus there is provided rolling mill apparatus which, by virtue of the fact that it does not incorporate universally jointed shafts, and the fact that all drive gears are in constant full mesh, will be capable of being driven at high speed and with high torque. In addition, the construction of the roll housing, and the means for adjusting the roll gap by eccentric sleeves, results in an extremely rigid arrangement capable of withstanding relatively heavy rolling forces. Since the roll housing is relatively simple and small, roll changing will be quick and simple and will not require complicated roll changing equipment. It will in fact be understood that, especially in the way in which roll changing can quickly and easily be effected, apparatus embodying the invention has many of the advantages of a so-called cantilever stand. It is, however, much more robust than a cantilever stand because of the fact that its rolls are simply supported, that is to say because of the fact that each roll has bearings at its opposite ends. In either mode of operation, a relatively wide range of roll diameters can be accommodated and a similarly wide range of roll speeds to suit a wide range of roll diameters can be brought about by fitting different input drive gearboxes. However, by virtue of the fact that the mechanism can be adjusted in such a way that the pinions 26,26 can be either the driving or driven gears and the gears 20,20 the driven or driving gears there is obtained a speed up or gearing down with a roughly corresponding increase in torque transmitting capacity, the roll housing being inherently capable of withstanding the consequent high stresses imposed on it throughout its extremely wide range of use by virtue of its construction and the manner in which the rolls are mounted for adjustment in the eccentric sleeves.

It will be understood that modifications may be made to the disclosed embodiment without departing from the spirit and scope of the invention. For example, the rolling mill need not necessarily incorporate an input drive gearbox. The drive from the drive shaft 86 could, in the installation illustrated in FIG. 9, be transmitted by way of suitable driving adaptors directly to the appropriate one of the pinions 26 or to the appropriate one of the drive gears 20, depending on the mode of operation being employed. A universally jointed shaft instead of the in-line drive shaft 86 could in fact be used at this location. This would then cater for the height variation which occurs when one of the gears 20 is to receive input drive instead of one of the pinions 26.

It will also be understood that although it is obviously desirable for the main frame and gear housing to be rotatably mounted for convenient positional adjustment into the selected one of its two angularly spaced positions, this is not essential. It could be re-positioned from time to time using a crane and some convenient means for clamping it in its required position. The roll housing need not necessarily be mounted in guides on an end face of the main frame and gear housing. Indeed, if the rolls are made relatively wide and of a relatively large diameter the roll housing may become too large to be mounted solely in such guides and it may need to be mounted on its own bed frame. It can however still be slidably adjustable in a direction perpendicular to a plane containing the axes of the rolls.

What I claim and desire to secure by Letters Patent is:

1. A rolling mill comprising:

a roll housing;

a pair of work rolls rotatable in said roll housing;

a main frame and gear housing;

respective drive gears located within said main frame and gear housing and in a first mode of operation of the mill drivably connected to said work rolls;

respective pinions located within said main frame and gear housing and in constant mesh with the respective drive gears, means, in said first mode of operation of the mill, for causing the pinions to mesh together and for accomodating orbital adjustment of the respective drive gears towards or away from each other around the respective pinions to thereby suit the spacing of the rolls in the roll housing;

means for locating the main frame and gear housing in either one of two positions angularly spaced at 180 degrees;

and first adjustment means for adjusting the drive gears and pinions within the main frame and gear housing between said first mode of operation of the mill and a second mode of operation of the mill at which the drive gears are in mutually meshing positions and the pinions are spaced apart and orbitally adjustable towards or away from each other about their respective drive gears to thereby suit a different spacing of the rolls in the roll housing, so that, depending upon the orientation of the main frame and gear housing and the adjustment of the gearing, there is obtained either a speed increase or a gearing down through the main gearbox, this providing a speed differential between the different roll drives obtained so that rolls of widely varying diameters can be driven at appropriate speeds.

2. A rolling mill as claimed in claim 1, wherein the drive gears and respective pinions with which they are in constant mesh are located in respective cage members and means for mounting said cage members for pivotal adjustment about the axes of the respective drive gears or of the respective pinions, selectively.

3. A rolling mill as claimed in claim 2, wherein said first adjustment means includes pairs of clamping plates pivotally movable about respective pivots, and means for securing said clamping plates in alternative positions in which respective pairs of part-circular apertures in said clamping plates selectively locate sleeve portions of said cage members concentric with the drive gears and pinions respectively in respective part-circular seatings formed within the main frame and gear housing.

4. A rolling mill as claimed in claim 3, wherein the pairs of clamping plates are movable about the respective pivots and secured in their alternative positions by means of a rotatable screw mechanism including a rotatable shaft with oppositely handed screwthreaded portions engaging respective nuts trunnion mounted between lever portions of the respective pairs of clamping plates.

5. A rolling mill as claimed in claim 1 further comprising second adjustment means for effecting adjustments of the roll centres towards or away from each other, said second adjustment means including pairs of eccentric sleeves located in bores in the roll housing, and guide means for accomodating readjustment of the roll housing in a direction perpendicular to a plane containing the axes of the rolls in order to maintain the rolls in axial alignment with the drive gears or with the pinions, as the case may be.

6. A rolling mill as claimed in claim 5, further comprising mounting means on opposite and faces of the main frame and gear housing for receiving the roll housing.

7. A rolling mill as claimed in claim 1, wherein the main frame and gear housing is rotatably mounted for convenient positional adjustment into the selected one of its two angularly spaced positions.

8. A rolling mill as claimed in claim 7, wherein a hydraulically operated rotary actuator is provided to rotate the main frame and gear housing into the selected one of its two angularly spaced positions.

9. A rolling mill as claimed in claim 7, wherein the main frame and gear housing is rotatable about a vertical axis for positional adjustment into the selected one of its two angularly spaced positions for use in the selected mode of operation of the mill, the rolls of the roll housing being mounted for rotation about horizontal axes and being located at one end of the main frame and gear housing.

10. A rolling mill as claimed in claim 7, wherein the main frame and gear housing is rotatable about a horizontal axis for positional adjustment into the selected one of its two angularly spaced positions for use in the selected mode of operation of the mill, the rolls of the roll housing being mounted for rotation about vertical axes and being located above the main frame and gear housing.

11. A rolling mill comprising:

a gear housing;

a pair of drive gears and a pair of pinion gears located within the gear housing;

carrier means for maintaining each drive gear in constant mesh with a respective one of said pinion gears;

means for adjusting said carrier means between a first mode of operation in which said pinion gears are intermeshed and said drive gears are spaced apart and orbitally adjustable towards and away from each other about their respective pinion gears, and a second mode of operation in which said drive gears are intermeshed and said pinion gears are spaced apart and orbitally adjustable towards and away from each other about their respective drive gears;

a roll housing;

a pair of work rolls rotatable in said roll housing;

means for mounting said roll housing on said gear housing with the axes of said rolls aligned with the axes of the spaced apart drive gears or pinion gears, as the case may be;

means for establishing a drive connection between each work roll and its respective axially aligned drive gear or pinion gear; and means for driving one of either the intermeshed drive gears or pinion gears, as the case may be.

12. The rolling mill of claim 11 further comprising means adjusting the spacing between said work rolls, and means for accomodating a shifting of the position of said roll housing with respect to said gear housing in order to maintain the axial alignment of the components establishing said drive connection.

* * * * *